US005967953A

United States Patent [19]

Nunez

[11] Patent Number: 5,967,953

[45] Date of Patent: Oct. 19, 1999

[54] LEG EXERCISER

[76] Inventor: Luis Alberto Nunez, P.O. Box 89-3011, Birri, Barva, Heredia 3001, Costa Rica

[21] Appl. No.: 09/090,180

[22] Filed: Jun. 4, 1998

[51] Int. Cl.[6] ..... A63B 21/02

[52] U.S. Cl. ..... 482/121; 482/128

[58] Field of Search ..... 482/121, 126–128

[56] References Cited

U.S. PATENT DOCUMENTS 2,106,994 2/1938 Chapman ..... 482/128
4,865,317 9/1989 Hickey ..... 482/126
5,743,830 4/1998 Ho ..... 482/126
5,807,217 9/1998 Endelman ..... 482/126

*Primary Examiner*—Jerome Donnelly

[57] ABSTRACT

A leg exerciser is provided including a pair of rods slidably coupled with respect to each other such that the same remain generally along a common axis. Also included is a pair of pads situated on ends of the rods. A tension mechanism is provided for urging the rods apart. In use, the pads are situated between knees of a user such that the same may be biased together to exercise leg muscles of the user.

7 Claims, 2 Drawing Sheets

LEG EXERCISER

BACKGROUND OF THE INVENTION

1. Field of the Invention

The present invention relates to exercise devices and more particularly pertains to a new leg exerciser for exercising leg muscles of a user which are commonly employed while riding a horse.

2. Description of the Prior Art

The use of exercise devices is known in the prior art. More specifically, exercise devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art exercise devices include U.S. Pat. No. 2,132,862; U.S. Pat. No. 4,483,533; U.S. Pat. No. 4,671,260; U.S. Pat. No. 4,861,022; U.S. Pat. No. 3,497,216; and Foreign Patents WO 89/03708 A1 & EP 0 566 586 A1.

In these respects, the leg exerciser according to the present invention substantially departs from the conventional concepts and designs of the prior art, and in so doing provides an apparatus primarily developed for the purpose of exercising leg muscles of a user which arc commonly employed while riding a horse.

SUMMARY OF THE INVENTION

In view of the foregoing disadvantages inherent in the known types of exercise devices now present in the prior art, the present invention provides a new leg exerciser construction wherein the same can be utilized for exercising leg muscles of a user which are commonly employed while riding a horse.

The general purpose of the present invention, which will be described subsequently in greater detail, is to provide a new leg exerciser apparatus and method which has many of the advantages of the exercise devices mentioned heretofore and many novel features that result in a new leg exerciser which is not anticipated, rendered obvious, suggested, or even implied by any of the prior art exercise devices, either alone or in any combination thereof.

To attain this, the present invention generally comprises a pair of linear rods each having a common length and a first end with a sliding assembly coupled thereto. As best shown in FIG. 3, each sliding assembly includes a first spherical member having a cylindrical recess formed therein for fixedly receiving the first end of the corresponding rod. Further, the sliding assemblies include a second spherical member fixedly coupled to the first spherical member with a diametrically disposed cylindrical bore formed therein. Such cylindrical bore remains in parallel relationship with the cylindrical recess of the first spherical member. In use, the cylindrical bore is adapted for slidably receiving an intermediate extent of one of the rods. With reference still to FIG. 3, the pair of linear rods further include a stopper assembly. This stopper assembly has a first spherical member with a diametrically disposed cylindrical bore formed therein for fixedly coupling to a first one of the rods. Such coupling is preferably effected adjacent to and spaced from the first end of the first rod. The stopper assembly further includes a second spherical member fixedly coupled to the first spherical member of the stopper assembly. The second spherical member of the stopper assembly is equipped with a diametrically disposed cylindrical bore formed therein which remains in parallel relationship with the cylindrical bore of the first spherical member of the stopper assembly. During use, the cylindrical bore of the stopper assembly is adapted for slidably receiving an intermediate extent of a second one of the rods. By this structure, separation of the rods is prevented past a predetermined extent. Next provided is a pair of pads each including a rigid disk-sliaped mount pivotally coupled to a second end of an associated one of the rods. This is preferably accomplished by way of a ball and socket joint, as shown in FIG. 4. Each mount has a cylindrical recess formed in an outer surface thereof for fixedly receiving a disk-shaped deformable cushion. Finally, a tension mechanism includes a pair of groove-defining brackets each mounted to an end of the first spherical member of the corresponding sliding assembly. A closed loop elastic band is situated between the grooves of the brackets for urging the rods apart. As such, the stopper assembly abuts the spherical members of one of the sliding assemblies of the rods. During operation, the pads are situated between knees of a user such that the same may be biased inwardly to exercise leg muscles of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new leg exerciser apparatus and method which has many of the advantages of the exercise devices mentioned heretofore and many novel features that result in a new leg exerciser which is not anticipated, rendered obvious, suggested, or even implied by any of the prior art exercise devices, either alone or in any combination thereof.

It is another object of the present invention to provide a new leg exerciser which may be easily and efficiently manufactured and marketed.

It is a further object of the present invention to provide a new leg exerciser which is of a durable and reliable construction.

An even further object of the present invention is to provide a new leg exerciser which is susceptible of a low cost of manufacture with regard to both materials and labor, and which accordingly is then susceptible of low prices of sale to the consuming public, thereby making such leg exerciser economically available to the buying public.

Still yet another object of the present invention is to provide a new leg exerciser which provides in the apparatuses and methods of the prior art some of the advantages thereof, while simultaneously overcoming some of the disadvantages normally associated therewith.

Still another object of the present invention is to provide a new leg exerciser for exercising leg muscles of a user which are commonly employed while riding a horse.

Even still another object of the present invention is to provide a new leg exerciser that includes a pair of rods slidably coupled with respect to each other such that the same remain generally along a common axis. Also included is a pair of pads situated on ends of the rods. A tension mechanism is provided for urging the rods apart. In use, the pads are situated between knees of a user such that the same may be biased together to exercise leg muscles of the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
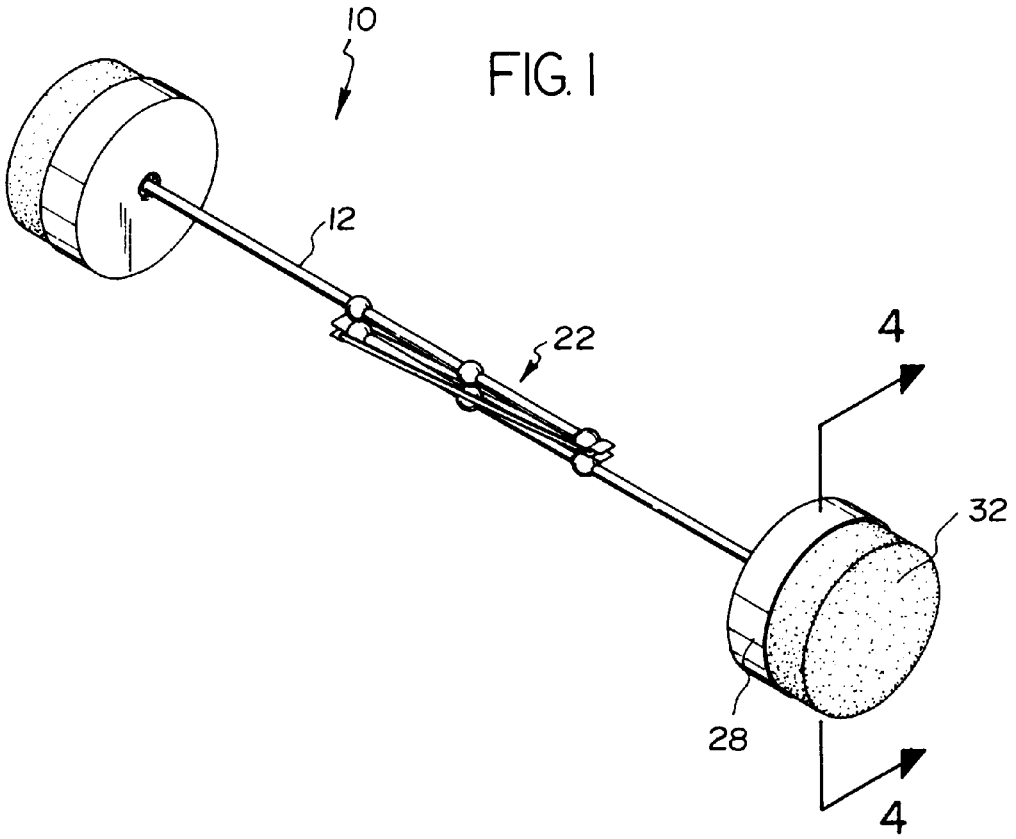
FIG. 1 is a perspective view of a new leg exerciser according to the present invention.
Figure 2:
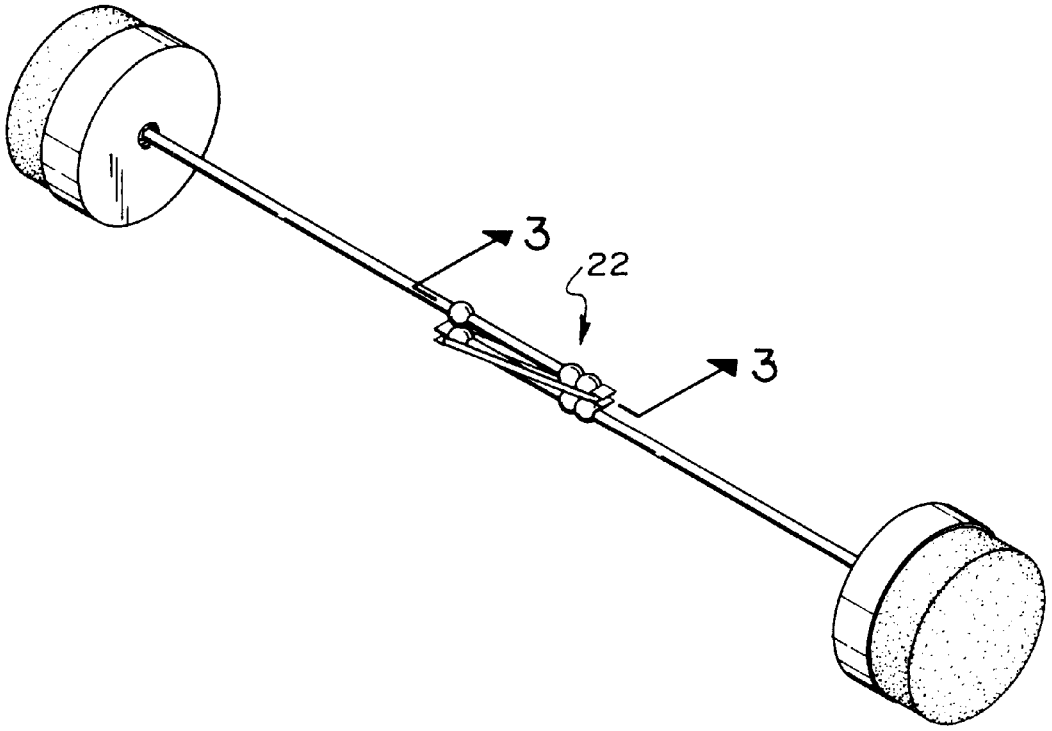
FIG. 2 is a perspective view of the present invention with the rods in an unbiased orientation.

With reference now to the drawings, and in particular to FIGS. 1 through 4 thereof, a new leg exerciser embodying the principles and concepts of the present invention and generally designated by the reference numeral 10 will be described.

Figure 3:
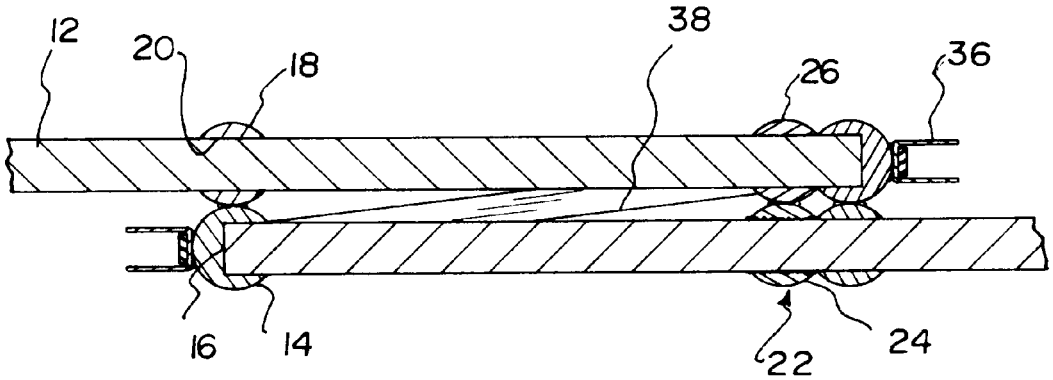
FIG. 3 is a cross-sectional view of the present invention taken along line 3—3 shown in FIG. 2.

The present invention, designated as numeral 10, includes a pair of linear rods 12 each having a common length and a first end with a sliding assembly coupled thereto. As best shown in FIG. 3, each sliding assembly includes a first spherical member 14 having a cylindrical recess 16 formed therein for fixedly receiving the first end of the corresponding rod. Further, the sliding assemblies each include a second spherical member 18 fixedly coupled to the first spherical member and with a diametrically disposed cylindrical bore 20 formed therein. Such cylindrical bore remains in parallel relationship with the cylindrical recess of the first spherical member. In use, the cylindrical bore is adapted for slidably receiving an intermediate extent of one of the rods. By this design, the rods are constantly maintained in parallel relationship.

With reference still to FIG. 3, the pair of linear rods further include a stopper assembly 22. This stopper assembly has a first spherical member 24 with a diametrically disposed cylindrical bore formed therein for fixedly coupling to a first one of the rods. Such coupling is preferably effected adjacent to and spaced from the first end of the first rod. In the preferred embodiment, the stopping assembly is fixedly positioned a distance from the first end equal to about ⅓ a length of the rods.

The stopper assembly further includes a second spherical member 26 fixedly coupled to the first spherical member of the stopper assembly. The second spherical member of the stopper assembly is equipped with a diametrically disposed cylindrical bore formed therein which remains in parallel relationship with the cylindrical bore of the first spherical member of the stopper assembly. During use, the cylindrical bore of the stopper assembly is adapted for slidably receiving an intermediate extent of a second one of the rods. By this structure, separation of the rods is prevented past a predetermined extent.

Figure 4:
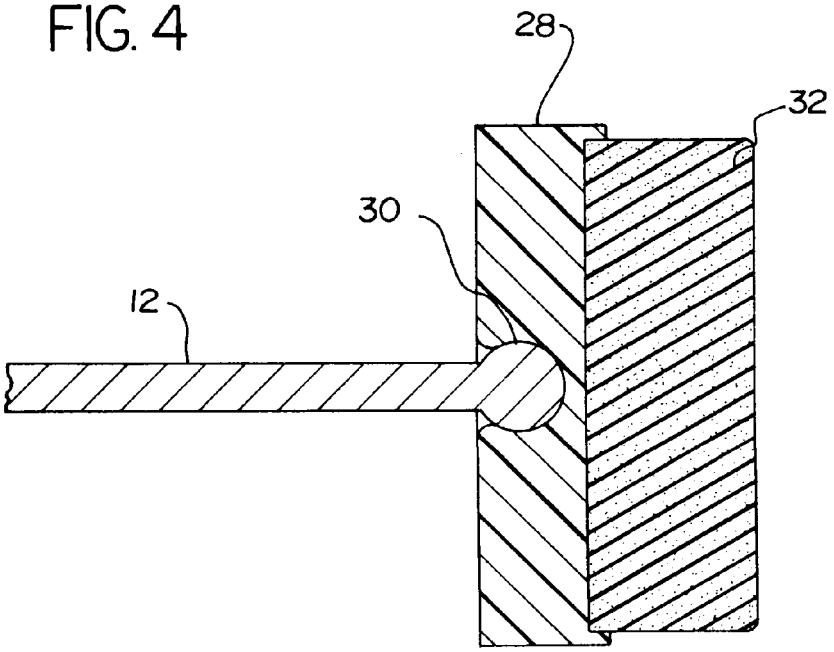
FIG. 4 is a cross-sectional view of the present invention taken along line 4—4 shown in FIG. 1.

Next provided is a pair of pads each including a rigid disk-shaped mount 28 pivotally coupled to a second end of an associated one of the rods. Thins is preferably accomplished by way of a ball and socket joint 30, as shown in FIG. 4. The socket preferably takes the form of a spherical recess formed in the mount. Each mount has a cylindrical recess formed in an outer surface thereof for fixedly receiving a disk-shaped deformable cushion 32.

Finally, a tension mechanism includes a pair of groove-defining brackets 36 each mounted to an end of the first spherical member of the corresponding sliding assembly. As shown in FIG. 3, each bracket is defined by a pair of square planar plates each extending outwardly from the corresponding sliding assembly in parallel relationship. A closed loop elastic band 38 is situated between the grooves of the brackets for urging the rods apart. As such, the stopper assembly abuts the spherical members of one of the sliding assemblies of the rods. During operation, the pads are situated between knees of a user such that the same may be biased inwardly to exercise leg muscles of the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A leg exerciser comprising, in combination:

a pair of linear rods each having a common length and a first end with a sliding assembly coupled thereto, each sliding assembly including a first spherical member having a cylindrical recess formed therein for fixedly receiving the first end of the corresponding rod and a second spherical member fixedly coupled to the first spherical member with a diametrically disposed cylindrical bore formed therein which remains in parallel relationship with the cylindrical recess of the first spherical member for slidably receiving an intermediate extent of one of the rods, the pair of linear rods further including a stopper assembly including a first spherical member having a diametrically disposed cylindrical bore formed therein for fixedly receiving a first one of the rods adjacent to and spaced from the first end thereof and a second spherical member fixedly coupled to the first spherical member of the stopper assembly with a diametrically disposed cylindrical bore formed therein which remains in parallel relationship with the cylindrical bore of the first spherical member of the stopper assembly for slidably receiving an intermediate extent of a second one of the rods, thereby precluding the separation of the rods past a predetermined extent;

a pair of pads each including a rigid disk-shaped mount pivotally coupled to a second end of an associated one of the rods by way of a ball and socket joint, each mount having a cylindrical recess formed in an outer surface thereof for fixedly receiving a disk-shaped deformable cushion; and a tension mechanism including a pair of groove defining brackets each mounted to an end of the first spherical member of the corresponding sliding assembly and a closed loop elastic band situated between the grooves of the brackets for urging the rods apart such that the stopper assembly abuts the spherical members of one of the sliding assemblies of the rods, whereby the pads are situated between knees of a user such that the same may be biased inwardly to exercise leg muscles of the user.

2. A leg exerciser comprising:

a pair of rods each having a sliding assembly for slidably coupling the pair of rods with respect to each other such that the same remain generally along a common axis, each sliding assembly including a first spherical member having a cylindrical recess formed therein for fixedly receiving a first end of the corresponding rod and a second spherical member fixedly coupled to the first spherical member with a diametrically disposed cylindrical bore formed therein which remains in parallel relationship with the cylindrical recess of the first spherical member for slidably receiving an intermediate extent of one of the rods;

a pair of pads situated on ends of the rods; and a tension mechanism for urging the rods apart, wherein the pads are situated between knees of a user such that the same may be biased together to exercise leg muscles of the user.

3. A leg exerciser as set forth in claim 2 wherein the pads are disk-shaped.

4. A leg exerciser as set forth in claim 2 wherein the rods are in spaced parallel relationship.

5. A leg exerciser as set forth in claim 2 wherein the tension mechanism includes an elastic band mounted between ends of the rods.

6. A leg exerciser as set forth in claim 5 wherein the elastic band remain exterior of the rods.

7. A leg exerciser as set forth in claim 2 wherein the rods have a stopper assembly for precluding the sliding of the rods apart past a predetermined extent by abutting at least one of the sliding assemblies.

* * * * *